US008720714B2

(12) United States Patent
Romero

(10) Patent No.: US 8,720,714 B2
(45) Date of Patent: May 13, 2014

(54) COMBINED BEVERAGE CONTAINER OPENER AND COVER

(75) Inventor: Jerome Romero, Santa Fe, NM (US)

(73) Assignee: Roadrunner Promotions, LLC, Albuquerque, NM (US)

( * ) Notice: Subject to any disclaimer, the term of this patent is extended or adjusted under 35 U.S.C. 154(b) by 559 days.

(21) Appl. No.: 10/641,971

(22) Filed: Aug. 15, 2003

(65) Prior Publication Data

US 2005/0035080 A1 Feb. 17, 2005

(51) Int. Cl.
*B65D 51/24* (2006.01)

(52) U.S. Cl.
USPC ..... 215/228; 215/295; 215/304

(58) Field of Classification Search
USPC ..... 215/228, 295, 302–304, 334, 319; 7/151; 81/3.09, 3.4, 3.07, 3.15; D8/38, D8/40, 34; D9/453; 220/229, 287, 254.1, 220/255
See application file for complete search history.

(56) References Cited

U.S. PATENT DOCUMENTS

| | | | | | |
|---|---|---|---|---|---|
| 1,916,115 | A | * | 6/1933 | Perkins et al. | 81/3.15 |
| 3,604,290 | A | * | 9/1971 | Waite | 81/3.4 |
| 4,337,678 | A | * | 7/1982 | Mumford | 81/3.4 |
| 4,414,865 | A | * | 11/1983 | Brooks et al. | 81/3.09 |
| 4,433,597 | A | * | 2/1984 | Rowland | 81/3.09 |
| 4,766,781 | A | * | 8/1988 | Grise et al. | 81/3.4 |
| 4,911,038 | A | * | 3/1990 | Ferrin | 81/3.09 |
| D383,953 | S | * | 9/1997 | DeFilippo | D8/38 |
| D383,954 | S | * | 9/1997 | Biunno | D8/40 |
| D408,236 | S | * | 4/1999 | Rennick | D8/38 |
| D432,375 | S | * | 10/2000 | Rennick | D8/38 |
| D439,482 | S | * | 3/2001 | Huang | D8/40 |
| D447,923 | S | * | 9/2001 | Taylor et al. | D8/40 |

* cited by examiner

*Primary Examiner* — J. Gregory Pickett
(74) *Attorney, Agent, or Firm* — Luis M. Ortiz; Kermit D. Lopez; Ortiz & Lopez, PLLC

(57) ABSTRACT

A multi-purpose device is disclosed for opening beverage containers, such as glass bottles, plastic bottles and/or cans and for covering some open beverage containers having a neck, such as beverage bottles. The device includes a housing. The housing can represent various decorative forms of head-gear. The housing includes a bottle cap remover and bottle retainer. For twist-off caps, a twist-off bottle cap remover can be provided that includes a cup-like guide member that can receive the cap of a beverage container. Ridges formed on and projecting outward from the surface of the cup-like guide member's inner circumference can be received by indentations between ridges typically found on the outer circumference of beverage container caps (e.g., bottle caps). By twisting the guide member, the twist-off cap becomes loosened for easy removal. The housing provides a user with the necessary leverage to facilitate application of twisting torque onto a twist-off bottle cap, or leverage necessary to pull a pop-off cap off of a bottle or cause a can-tab to perforate the upper surface of a can. The device can include at least one bottle cap opener (e.g. twist-off or pop-off) and a lift tab opener for standard soda can. The bottle retainer can be integrated within the decorative housing, should be formed of a flexible material that will enable the device to be retained at the neck of an opened beverage bottle, thereby enabling cover for an opened bottle.

7 Claims, 8 Drawing Sheets

COMBINED BEVERAGE CONTAINER OPENER AND COVER

FIELD OF THE INVENTION

The present invention relates to a multi-purpose device for opening various beverage containers, especially liquid containers such as drink bottles with twist-off or pop-off caps, and cans with lift-tab openers. The present invention also relates to bottle capping devices. More particularly, the present invention relates to a combined multi-purpose beverage container opener and covering device.

BACKGROUND

Beer and soft drink bottles with pop-off or twist-off caps, and cans with lift-tab openers are in relatively widespread use and tend to require a degree of manual dexterity and strength to be opened. Many individuals have difficulty in opening some or all of these containers without mechanical assistance, and frequently resort to makeshift implements (e.g., keys) in order to open a container. Opening a container such as a soda can may lead to fingernail damage. Oftentimes, a bottle cap opener is not available for use on pop-off caps and twist off caps are difficult to open where arthritis, youth or seniority is a human factor.

There have been attempts in the past at addressing the need for all of the aforementioned problems through the provision of multi-purpose container opening devices. Examples of devices providing container opening capabilities are illustrated and described in the following U.S. Pat. Nos. 4,911,028; Des. 399,108; Des. 406,505; Des. 429,452; and Des. 432,375. The design patents illustrate aesthetic features for container openers that are miniature representations of sports headgear, such as football helmets, baseball helmets, and baseball caps. U.S. Pat. No. 4,911,038 describes utilitarian features for a multi-purpose container opener that can be found in the art. Referring to FIG. 1 (labeled as "Prior Art"), a container opener is illustrated that includes a first, generally circular guide portion 10 of inverted, cup-shaped configuration. Directly above the guide portion 10, and concentrically aligned therewith, is a second generally cup-shaped circular portion 11. The internal surface of the guide and cup-shaped circular portions 10, 11 together form a gripping portion for use to dislodge a twist-off cap from a beverage bottle. A shoulder-forming wall 17 is described in the '038 patent is being located between the guide 10 and cup-shaped portion 11. The internal wall 15 of the gripping portion is shown to be molded integrally with the guide member 10 and cup-shaped circular portion 11. The gripping portion 15 is shown provided with a generally cylindrical wall 25 of a diameter and height suitable to fit easily over The top of a twist-off cap 36 (see FIG. 2). To this end, the internal diameter of the wall is said to be on the order of 1.192", with a height of approximately 0.330". The gripping portion 15 is defined by a wall provided with a plurality of closely spaced, longitudinally extending ridges 18 (but can also be referred to in the art as ribs, islands, teeth, etc.) of generally triangular cross section). The dimensioning and spacing of the ridges 18 is explained as mostly a function of the configuration of conventional twist-off bottle caps. The illustrated form of the '038 patent is said to utilize twenty-one equally spaced ridges 18, each having a root dimension of about 0.103" with side walls tapering at an angle of approximately a radius 45 degrees. Projecting radially outwardly from the circular portions 10, 11 is an integral handle portion 12 provided at its outer extremity with a beverage can tab lifting portion 13.

Referring to FIG. 2 (also labeled as prior art), in order to remove a twist-off bottle cap 36, the multi-function opening device is applied over the top of the capped bottle 41 until the cap 36 is seated within the gripping portion 15, with the ridges 18 engaged with the flutes 40 of the bottle cap 36. With the bottle cap thus tightly gripped, torque can be applied to the device, according to the '03 patent with the aid of the handle 12, to easily apply the break-away torque to release the cap 36 and enable it to be quickly removed from the bottle 41.

Referring to FIG. 3 (also labeled as prior art), a tab opener typically includes a metal or aluminum lift tab element 43 that is normally disposed tightly against the top surface 46 of a drink beverage can 44. The lift tab 43 is typically raised by inserting fingernails under the lift tab and applying upward force with the fingers, causing a circular portion of the container lid 45 to break-away and pivot inwardly of the top surface 46 of the beverage container 44. The initial lifting of the tab element is sometimes difficult and can frequently cause damage to the fingernails.

The handle taught in the '038 patent and described herein includes a basic thickness of about 0.157", and further states that the outer section 13 may be tapered down to a thickness of about 0.04" for a distance of, for example, 0.7". As shown in FIG. 1, the side margins 22 of the handle, on each side of the tapered portion 13, are said to be provided of a full thickness, so as to apply more gentle pressure to the hand of the user during the application of torque for opening of bottles or cans. The tapered extremity 13 of the handle is designed to be slipped under a lift tab 43 of a conventional tab-opening soda can 44 as illustrated in FIG. 3. After sliding the tapered portion of the handle underneath the lift tab 43, the handle may be pried upwardly to raise the lift tab 43 and cause the break-away portion 45 of the can lid to be released. Once the lift tab 43 is raised sufficiently from the surface of the can lid 46, it may be easily gripped and manipulated by the user's fingers, without concern for breaking fingernails or otherwise causing discomfort.

Beverage containers are oftentimes served in establishments that are open to the public. For example, bars, nightclubs, sporting events all serve beverages. In bars and nightclubs, patrons are often concerned with misplacement or tampering of their drink. A misplaced drink must be replaced with the purchase of a new drink, which can be unfortunate where a substantial amount of beverage remained prior to the misplacement. The wait-staff (e.g., waiters, waitresses or bartenders) at the establishment are also known to prematurely collect patron drinks if the drink is left unattended. Of great concern these days is the mischievous use of narcotics, such as Exstacy, in nightclubs. Allegations of drink tampering cause apprehension by patron to leave drinks unattended. The present inventor recognizes this concern and believes that a beverage container cap would help at least partially address some of the foregoing concerns.

Although prior attempts have been made to provide a combined container opener and container openers that provide aesthetic features that may appeal to the sports industry, a combined beverage container opener and beverage cover or cap has not be heretofore presented, however, following a teaching of the present invention it should become recognized that the present invention is an ideal solution to many needs associated with the use of beverage containers and enjoyment of beverages contained therein.

SUMMARY OF THE INVENTION

One of the objectives of the invention is the provision of a novel, highly simplified, economically manufactured device that greatly facilitates opening of several beverage container types. Another objective of the present invention is to provide a means to cover the opening of a beverage container (e.g., bottle openings typically found after removal of a twist-off or pop-off bottle cap), especially when used in public environments.

In light of the aforementioned objectives, it is an aspect of the present invention to provide a beverage container opening device that includes a generally circular guide and gripping portion in the form of a generally inverted cup and including formed on the inner surface therein a gripping material, which can be provided in the form of ribs, flutes or ridges. The guide and gripping portion are received over the removable bottle cap typically found to be secured to the opening formed in the top of a beverage container. The gripping material can extend into and/or downward into a substantially complimentary surface and outer perimeter formed on the removable bottle cap. The guide and gripping portion is preferably integrally associated or secured within a three-dimensional decorative housing formed in the shape of headgear (e.g., football helmet, baseball cap, cowboy hat, etc.) that can represent miniaturized sports headgear and can further serve as a means for a user to control bottle opening functions of the guide and gripping portion by providing sufficient leverage to the guide and gripping portion so that the torque necessary for removing a bottle cap from a beverage container can be achieved even by a person possessing the most modest strength and dexterity.

In accordance with a method of using the twist-off bottle cap removal feature of the present invention, the guide and gripping portion are received in gripping relation to a standard twist-off bottle cap for its removal from a bottle. After firm placement of the guide and gripping portion over the bottle cap, the bottle cap can be twisted off of the beverage container. Thus, the decorative housing can easily enable a user to place the guide and gripping portion over the top of a beverage provided with a twist-off bottle cap and then the bottle cap can be rotated with the decorative housing.

In accordance with another aspect of the invention, concentrically associated with the opening of the guide member is a bottle opening cover which can be provided in the form of bottleneck gripping seal and can further be provided in the form of a ring or series of flanges formed of a rubber-like material. The Bottleneck griping seal enables the beverage container opening device to now also be retained by the exterior surface of the neck of a beverage container provided in the form of a bottle when the device is being used as a cover for the opened beverage container. Thus, the guide member is a bottle cap gripping member of generally inverted cup-like configuration and the bottleneck gripping seal is preferably integrated within the device such that it is position next to the guide member before its opening.

In accordance with another feature of the present invention, the beverage container opening device can be provided that includes a combined bottle cap remover and a bottle opening cover device for opening and covering an opened bottle. The bottle cap remover can be in the form of at least one of a twist-off bottle cap remover or a pop-off bottle cap remover and the cover. Preferably both bottle cap removers can be provided in a decorative, three-dimensional housing appearing like headhear of the variety described above, and furthermore with a cover provided in the form of a bottleneck retainer. Additionally, a pull-tab or can-tab opener can be provided on the same housing along the opening of the housing where the bottle cap remover/cover is received and retained. The present invention can then provide for a container opener than can open three types of beverage container (e.g., by removing twist-off, bottle caps, by removing pop/pull off bottle caps, and by manipulating pull tab typically found on beverage canisters), and an also include a bottle opening cover. The combination of twist-off and pop-off bottle cap remover in a single three-dimensional, mini headgear looking housing would provide opening associated with the bottle cap removers that removal of any bottle cap that may rest within the housing can be easily removed from the housing after removal from a bottle using twist-off caps. The opening should be adequate enough to allow a user's thumb, finger or other device access to the guide member to dislodge and remove the cap after its removal from its container should the cap become stuck within the opener.

In accordance with a feature of the present invention, the beverage container opening device can provide an opening associated with the guide member and gripping seal that is adequate to allow removal of any bottle cap that may rest within the guide member and gripping seal after it removal from a bottle. The opening should be adequate enough to allow a user's thumb or finger access to the guide member to dislodge and remove the cap after its removal from its container.

In accordance with another feature of the present invention, the decorative housing can also be provided with integrated lift tab portion that can facilitate the opening of tabs commonly associated with the sealing of canned beverages. The decorative cover, otherwise provided in association with the bottle opener, can include a thinly tapered extremity formed on outer end and/or edge of the decorative cover representing the back of headgear or can be formed as a portion of the front "visor portion" of the decorative cover provided in the form of headgear. For example the thinly tapered extremity or modified visor portion should be easily inserted underneath the lift tab element of a beverage can to enable the tab to be raised by a lifting/prying action of the handle. Generally, with the increased force and leverage of the prying handle a tab should be easily lifted and the breaking-away of the opening element of the can accomplished. The device should leave any lift projecting upwardly at a convenient angle to be engaged by the fingers to complete the opening. A small narrow extremity or modified visor portion facilitates the initial engagement and raising of the lift tab and enables a broader, tapered portion of the extremity or modified visor to be more easily inserted under the lift tab.

Additionally, it is an advantage of the present invention that the small, narrow extremity or modified visor, referred to above, can also be used to advantage in the opening of milk jugs and like provided with tamper-resistant closures of the type having a pull tab element for releasing the cap for removal. For closures of that type, the extremity or modified visor can be inserted in slot at the end of the closure pull tab. The decorative cover is then handled and/or otherwise manipulated to break the pull tab free from its container. Thereafter, the pull tab can be easily pulled by hand to free the cap.

Another feature of the present invention can enable the opening of pop-off caps typically associated with import beverage containers. In accordance with this feature of the invention, an opening can be formed on at least one side (e.g., the back) portion of the decorative housing, but which can be associated with the back of headgear such as opening commonly found at the back of a baseball cap. The opening should preferably be formed to enable the reception of a portion of the pop-off cap and a portion of the bottle it is associated with. Integrated with the opening near an area where the ridge of the cap located between the cap and its bottle, should preferably be formed a tab with tensile strength that is adequate to pry and dislodge the cap from its bottle, causing the cap to "pop off" the bottle.

For a more complete understanding of the above and other features of the invention, reference should be made to the following detailed description of a preferred embodiment of the invention, and to the accompanying drawings.

DESCRIPTION OF THE PREFERRED EMBODIMENT OF THE INVENTION

The present invention is now herein described for the useful provision of a novel, highly simplified, economically manufactured device that facilitates opening of several beverage container types and furthermore, facilitates the security or preservation of beverages in public by serving as a cover for beverages consumed in public.

Referring to FIGS. 4A-4E, several views of a beverage container opening and covering device 400 are illustrated in accordance with the features and aspects of the present invention. As shown in the FIGS. 4A-4E, the device 400 includes a housing 401 provided in the form of a football helmet for exemplary purposes only. It should be appreciated by those skilled in the art that the present invention is not limited to use of a housing 401 formed in the shape of any particular form of head gear. Head gear of various shapes can be utilized to carry out the novel aspect of the present invention. The housing 401 can be made to take the form of, for example, baseball caps, cowboy hats and numerous other trade-related or casual headgear or head covers that can be imagine by skilled artisans (e.g., construction hard hats, space helmets, military headgear, cultural head covers). Whatever the design choice for the housing 401, it should serve as an adequate means for a user to control bottle opening functions and provide sufficient leverage to most any user so that torque necessary for removing a cap or manipulating a tab from a beverage container can be achieved even by a person possessing the most modest strength and dexterity.

Figure 1:
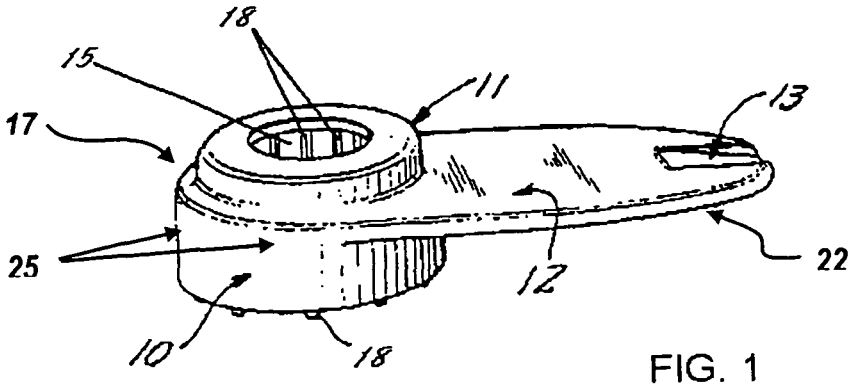
FIG. 1 (Prior art)
FIGS. 1 through 3 are labeled prior art and provide views of a prior art multi-purpose device for opening containers and how it is used.
Figure 2:
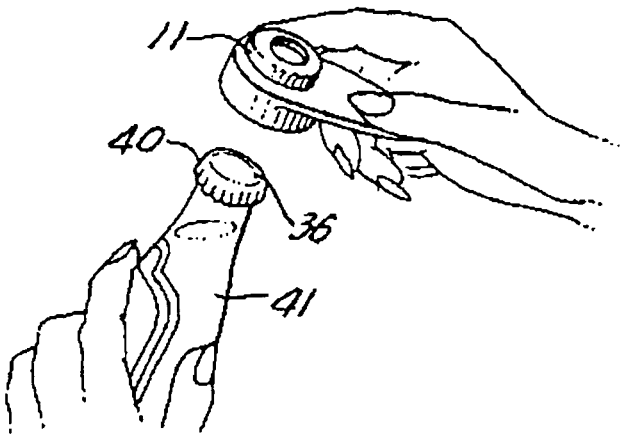
FIG. 2 (Prior art)
Figure 3:
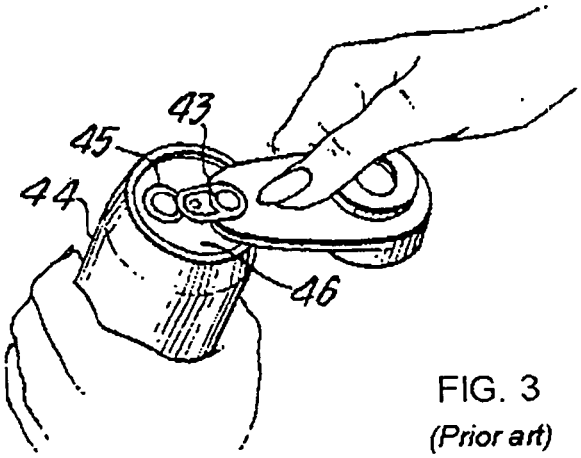
FIG. 3 (Prior art)
Figure 4A:
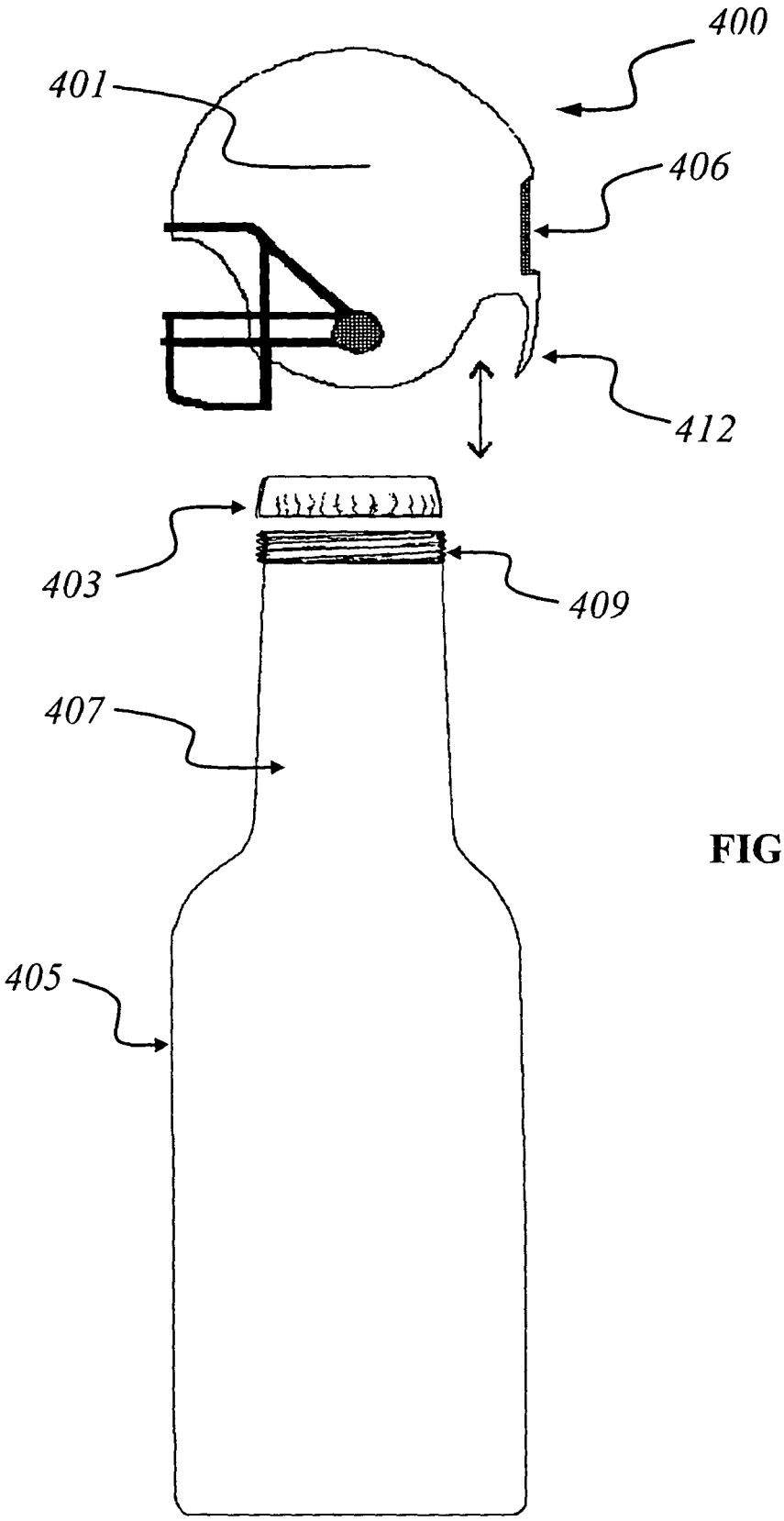
FIGS. 4A-4E illustrates plan views of a decorative housing for the present invention provided, without intending limitation, provided in the form of a football helmet.

A representation of a typical beverage bottle 405 is shown in FIG. 4A. The typical beverage bottle 405 includes a neck 407 that terminates at its top with a threaded and/or lipped opening 409 to which a removable bottle cap 403 (the crown associated with screw-type of pop-off beverage bottles) can be firmly attached during bottling. An opening device in accordance with the present invention is also shown in FIG. 4A. The device 400 includes a housing 401, which can take-on a decorative headgear formation, and means to open a beverage container. The means described herein for opening a beverage container include a twist-off cap remover, which is not shown in FIG. 4A but is shown and described in more detail in FIG. 4C by reference to numeral 429, a pop-off cap remover 406 shown generally integrated on the outer surface of the housing 401, and a pull-tab opener 412, also shown generally integrated on the housing 401. As depicted in FIG. 4A, the beverage container opening and covering device 400 can be lowered onto the top of a bottle 405, being of the twist-off cap variety, wherein the housing 401 accepts the cap 403 associated with the bottle into the housings interior wherein the device 400 is guided over the twist-off cap 403 until it is firmly placed in contact with the cap 403 so that is can be twisted off of the bottle 405 by the bottle opening device 400 using the gripping portion 409/429, which is explained in more detail in FIG. 4C, FIG. 5, FIG. 6, FIG. 8*c*, and FIG. 9*c*. After the bottle is opened, the device can also be used as a cover for opened bottles. The device, as will be described in further detail, can be placed over the bottle where it is retained as a cover by the bottles thread or lipped opening using bottle retention material 510 (see FIG. 5).

Figure 4B:
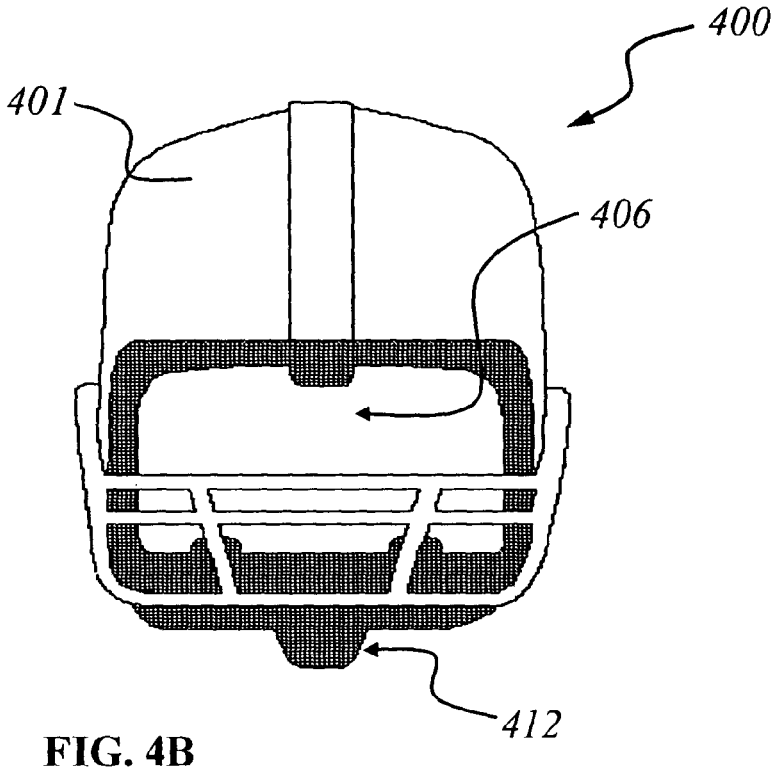
Figure 4C:
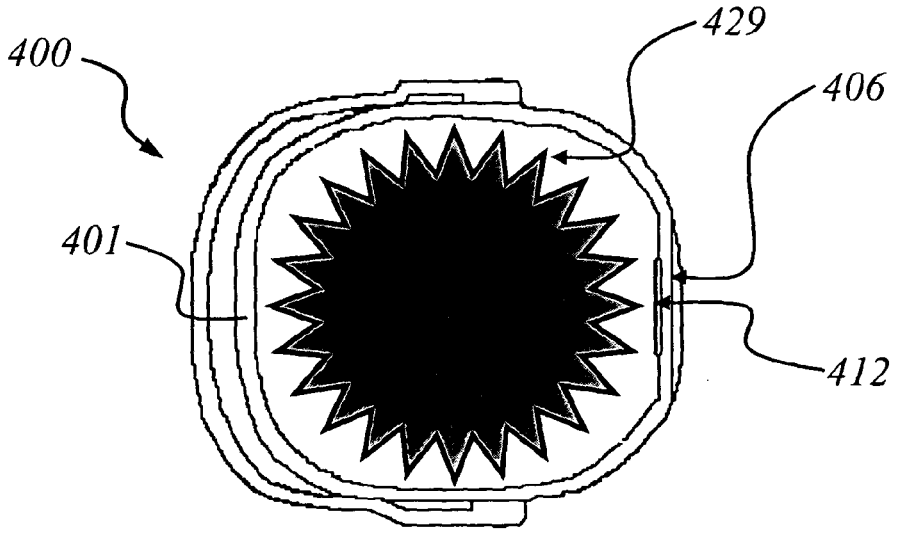
Figure 4D:
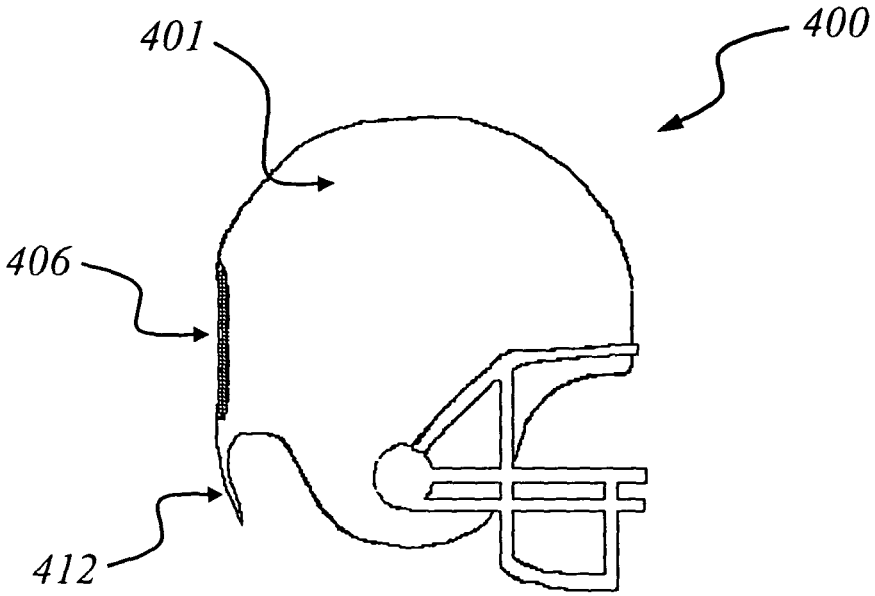
Figure 4E:
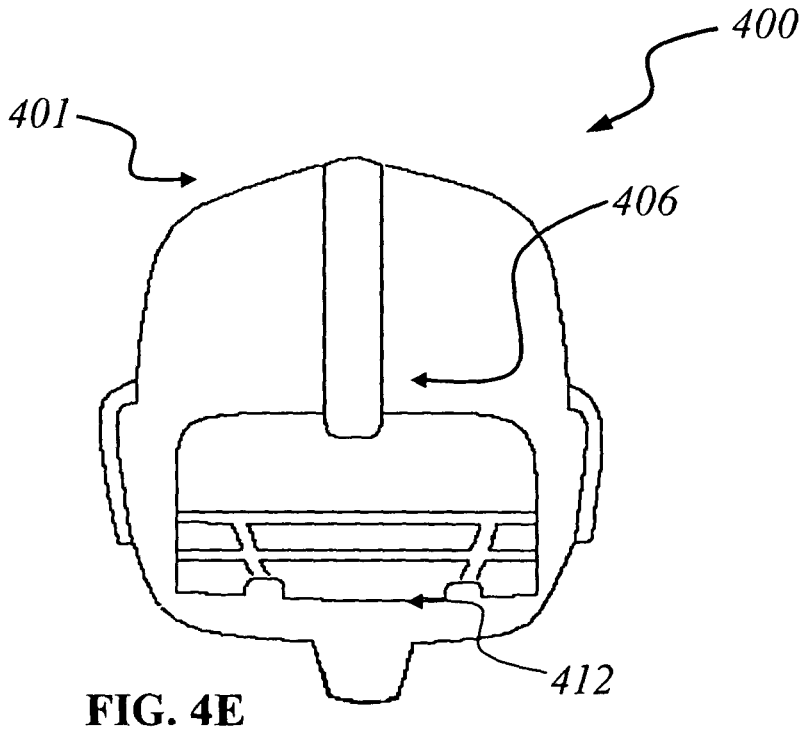

FIG. 4B illustrated a front view of the beverage container opening and covering device 400, FIG. 4C illustrates a bottom view of the device 400, FIG. 4D illustrated a side view, and FIG. 4E illustrated a back view of the device 400. In FIGS. 4A-4D, an optional location for a pop-off cap opener 406 and can tab opener 412 is shown. In FIG. 4C, a guide and gripping portion 409 useful for securing and removing a twist-off bottle cap from a bottle is shown. It can be appreciated by those skilled in the art how each container opening device can be used and designed in light of the teaching under U.S. Pat. No. 4,911,038, which is herein incorporated by reference.

Figure 5:
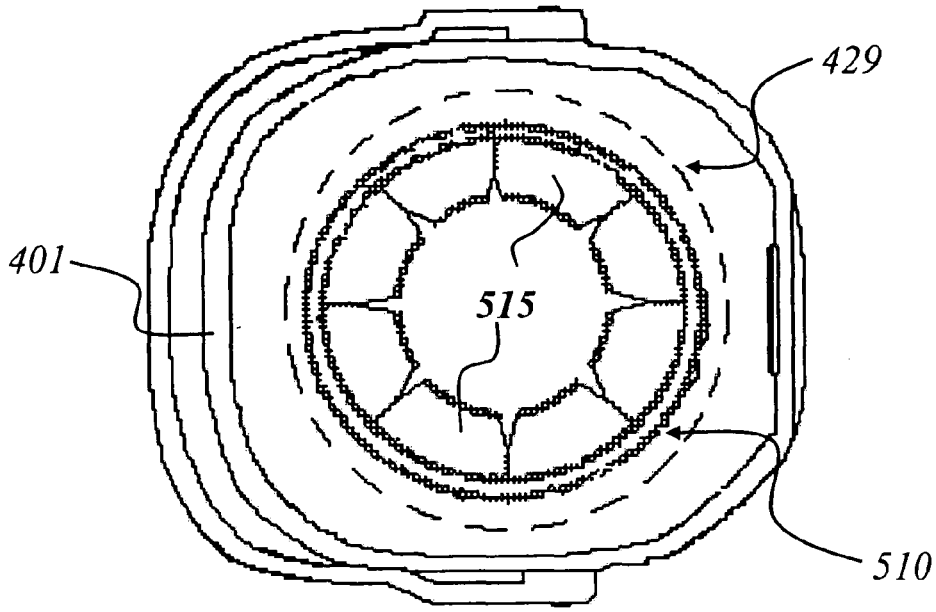
FIG. 5 is a perspective side view of the container opening device of FIG. 7 again showing an approximate location for the guide and gripping portion, bottle retaining portion within the decorative housing, and also showing possible locations for the can opener and pop-off cap portion of the device.

In accordance with another aspect of the invention that is now shown in FIG. 5, concentrically associated with the opening of the housing 401 is a bottleneck retainer 510 that can be provided as a sheet or layer of material (e.g., rubber) having formed thereon a flexible O-ring or series of flanges providing an opening for receiving the cap and neck of a bottle. From this view, the perimeter of the twist-off bottle cap opener 409 is shown by a dashed circle. The twist-off bottle cap opener 409 is not fully shown in the drawing because it is located within the housing 401 behind bottleneck retainer 510. Bottleneck retainer 510 is used to hold the housing onto the neck of a bottle just below the bottle's threaded or lipped (bottle features as described in FIG. 4A) when the device is being used as an opened bottle cover. When the bottleneck retainer 510 is provided in an o-ring-like configuration, its effective opening diameter, when un-stretched, should be smaller than the neck of a typical beverage containing bottles. When provided as a plurality of flanges 515, similar to those shown in FIG. 5, the material should normally maintain their placement in front of the opening in the housing 401 before the twist-off bottle cap opener 409. The flanges should be flexible enough to allow a bottle cap entry into the housing, but rigid enough to press against the neck of a bottle for retention of the bottle by the flanges 515. The bottleneck retainer 510 should enable the beverage container opening device to be retained by the exterior surface of the neck 407 of a bottle 405 beverage container beneath the threaded or lipped opening 409 as described with respect to FIG. 4C. It can be appreciated that the bottleneck retainer 510 can also serve as the guide member for receiving a bottle cap 403 into the device before its removal from the bottle 405.

Figure 6:
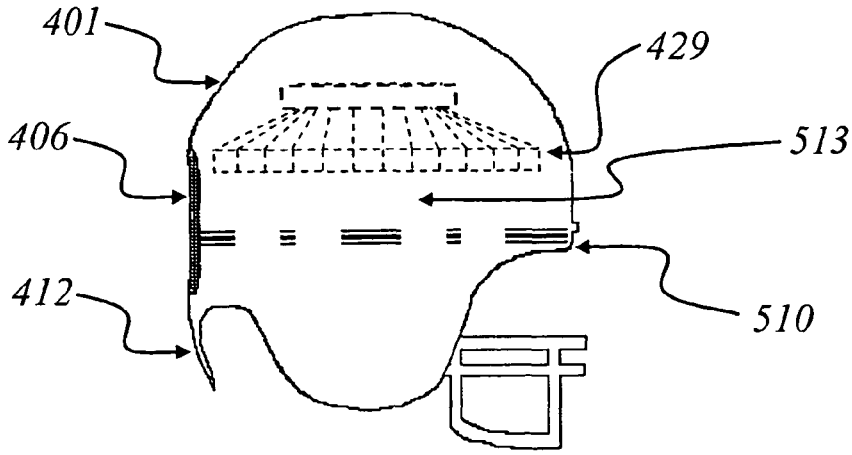
FIG. 6 is a perspective bottom view of the container opening device showing an approximate location for the retaining portion.

Referring to FIG. 6, a side view of the housing 401 is shown. The location of twist-off bottle cap remover 409 is shown using dashed lines to be located in the upper portion of the housing 401. A pop-off bottle cap remover 406 is also shown located in the rear portion of the helmet and a can tab opener 412 is shown extending from the housing at the rear of its base. The bottle retainer 510 is illustrated via a thick dashed line to be located in the housing 401 beneath the twist-off cap remover 409. A space 513 defined within the housing between the twist-off cap remover 409 and the bottle retainer 510 can hold a cap after its removal from a bottle. The space 513 can be accessed through the opening defined in the rear of the housing 401 by the pop-off bottle cap remover 406. Access to space 513 via the pop-off bottle cap remover 406 can allow a user to push the cap out of the housing 401 using a finger, key or other elongated object (not shown).

Figure 7A:
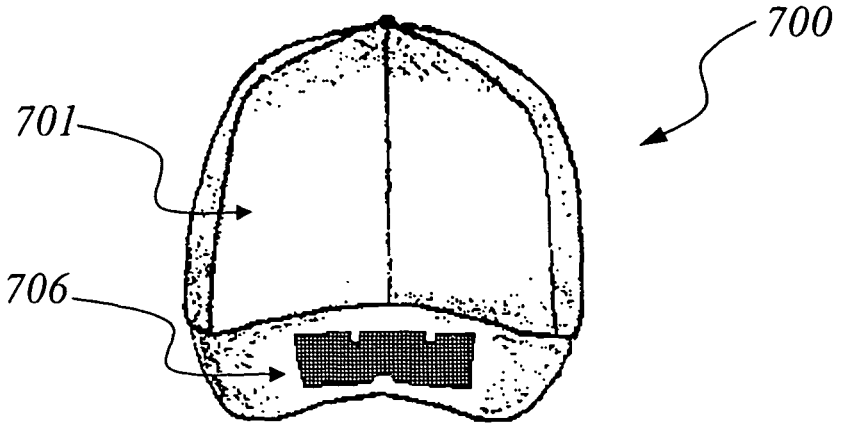
FIGS. 7A-7C illustrates plan views of a decorative housing for the present invention provided, without intending limitation, in the form of a base ball cap.
Figure 7B:
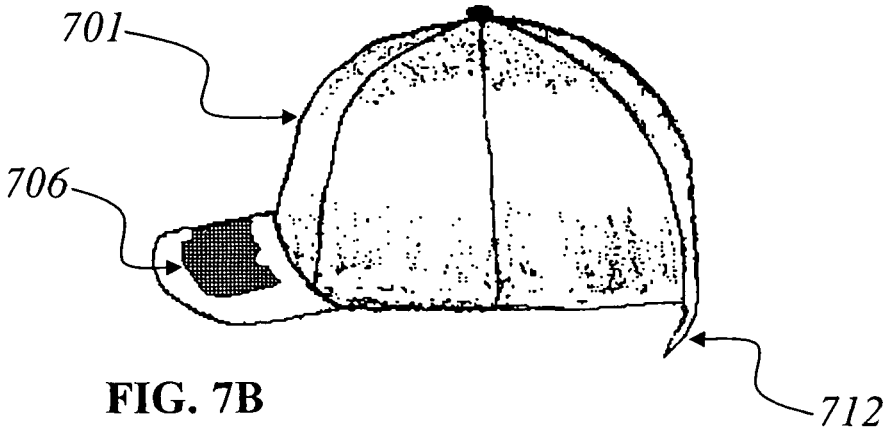
Figure 7C:
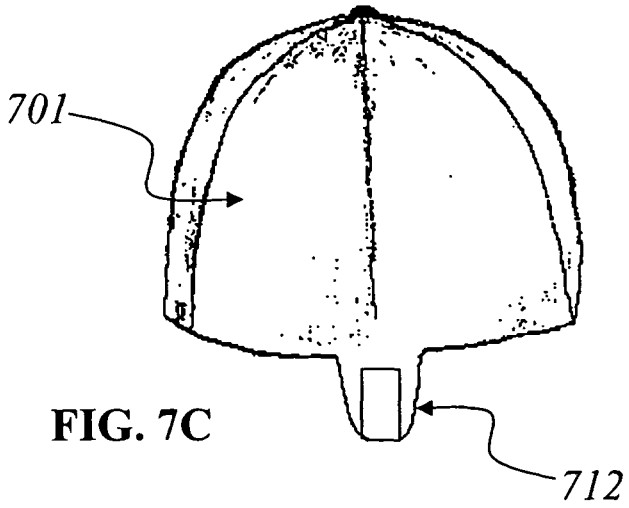

Referring to FIGS. 7A-7C, an alternative embodiment for a beverage container opener and cover 700 are shown. This time the housing 701 is optionally provided in the decorative shape of a baseball cap. An alternate location for a pop-off cap remover 706 is shown to be on the visor of the cap, as shown FIG. 7A; however, this location could also alternatively serve as the location for a can tab opener, which would then require relocation of the pop-off cap remover to the back of the housing 701 in a manner similar to that taught with respect to locating the pop-off opener 406 in the housing 401 described in FIGS. 4A-4E. In FIG. 7B, the location for the can tab opener 712 is shown at the rear of the housing 701; but it should be appreciated that it alternatively could be relocated to the visor as already described. The housing 701 rear location for the can tab opener 712 is also shown in FIG. 7C. As can be appreciated by the skilled, a twist-off bottle cap remover and bottle retainer would be located inside the housing similar to their location as provided for in the description of FIG. 4C and FIG. 5.

Figure 8A:
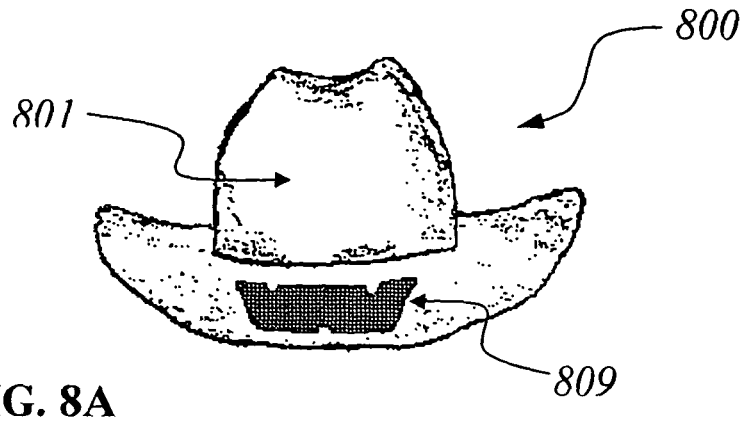
FIGS. 8A-8C illustrates plan views of a decorative housing for the present invention provided, without intending limitation, in the form of a cowboy hat.
Figure 8B:
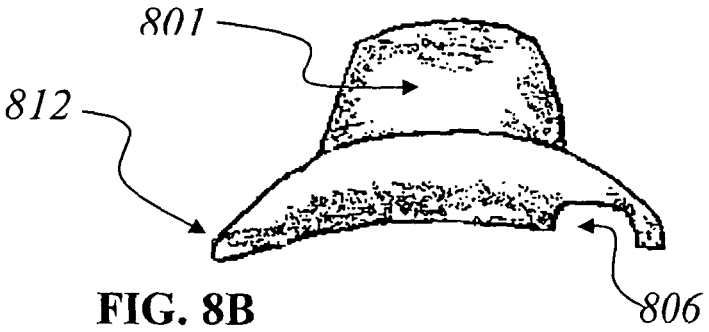

Another representation for the beverage container opener and cover 800 is shown in FIGS. 8A-B. This time a cowboy hat is used to define the housing 801, which can allow the can tab opener 812 and the pop-off bottle cap remover 806 to be located on the simulated brim or visor of the hat-like housing 801. In FIG. 8A, the pop-off bottle cap remover 806 is formed within the housing (e.g., hat's) brim. FIG. 8B shows the pop-off bottle cap opener 812 formed in the brim for housing 801, and also illustrated is an alternate location for a can tab remover 812, which can also be on the housing's 801 simulated hat brim/visor.

Figure 8C:
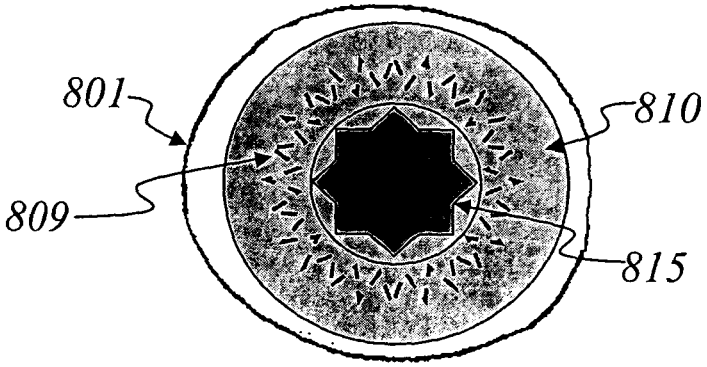

Referring to FIG. 8C, a bottom view of the housing 801 is shown. Dashed lines represent a twist-off bottle cap remover 809 located within the housing 801 behind a bottle retainer 810. The bottle retainer 810 is shown having star-like or gear-like flanges 815. The diameter of the general opening 816 of the bottle retention portion 810 can be large enough to accept any bottle cap and bottle neck, yet the flanges 815 when suspended in their normal, extended state form a small enough diameter as extensions to the general opening 816 to enable retention most bottle necks associated with beverages so that the device 800 will remain covering the contents of the bottle until it is physically removed by a user.

Figure 9A:
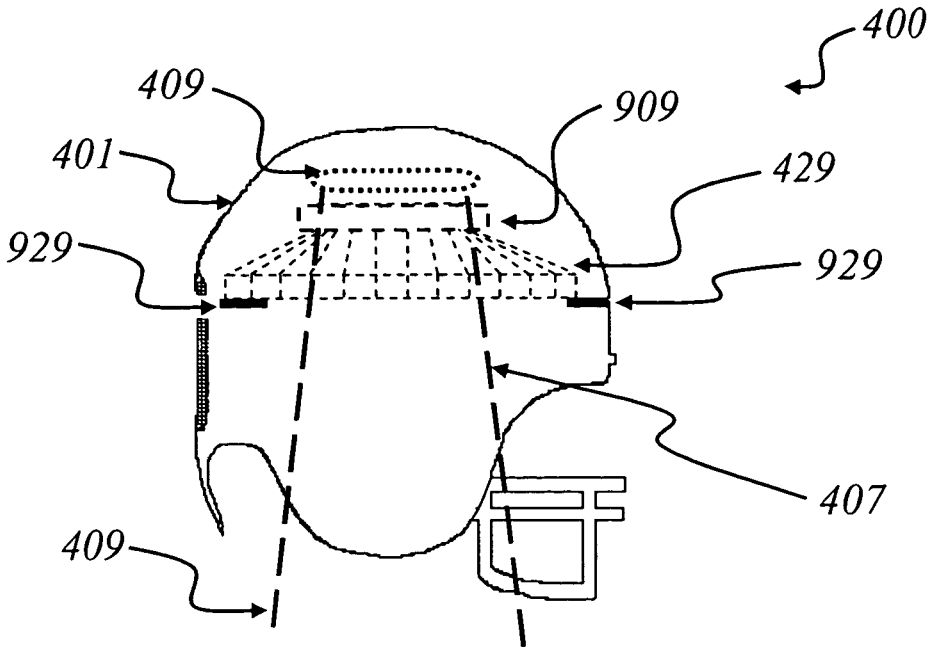
FIG. 9A illustrates a representation of a beverage container opening and covering device modified with a retention mechanism, which can securely hold the device onto a bottleneck.

Another representation of the beverage container opening and covering device 400 featured in FIG. 4A is shown with some modification in FIG. 9A. Referring to FIG. 9A, housing has formed on its the inner surface a retention mechanism 929, which can be provided in the form of a mostly continuous ridge or tabs, that are integrated with the material comprising the housing 401. During assembly the twist off cap remover 429 can be inserted into the housing 401 wherein it is locked or snapped into place within the housing 401 and permanently retained by the retention mechanism 929. The typical beverage bottle 405 includes a neck 407 that terminates at its top with a threaded and/or lipped opening 409 to which a removable bottle cap 403 can be firmly attached during bottling. As also shown in FIG. 9A, the twist-off cap remover 429 has a flexible ring 909, such as an o-ring, integrated with the twist-off cap remover 429 near its top. The Ring 909 has an opening adapted to receive the threaded and/or lipped opening 409 of the bottle 409. The ring 909 can securely hold the beverage container opening and covering device 400 onto the bottleneck 407.

Figure 9B:
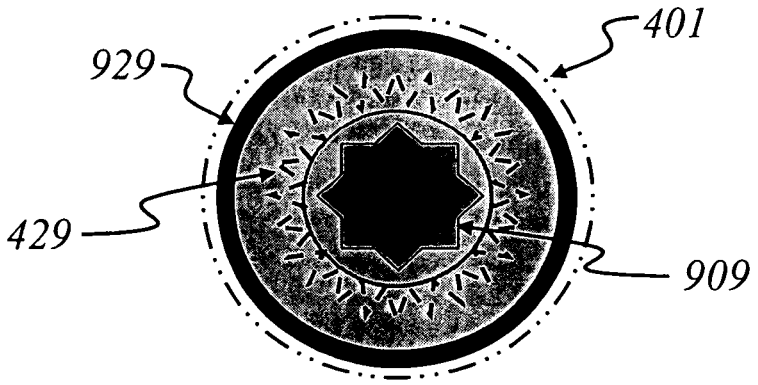
FIG. 9B illustrates a bottom perspective of a twist-off cap remover retained with the housing along with the retention mechanism.

Referring to FIG. 9B, a bottom perspective of the twist-off cap remover 429 being retained with the housing 401 with the retention mechanism 929 is shown. As shown in the center of the twist-off cap remover 494, the ring 909 includes flexible flanges, which can be helpful in securing the bottle opener and cover to a bottle at its head 409.

In accordance with a feature of the present invention stated in the Summary, the beverage container opening and covering device provides an opening associated with the guide member and gripping seal that is adequate to allow removal of any bottle cap that may rest within the guide member and gripping seal after it removal from a bottle. The opening should be adequate enough to allow a user's finger, key, pen or other available, elongated device to access to the guide member to dislodge and remove the cap after its removal from its container. Cap discharge can also be carried out where a pop-off bottle cap remover is provided that provide access to the housing area.

It should be appreciated that the present invention can include at least one bottle-cap remover and an opened bottle cover that can be used in a manner wherein it is presented in the form of a bottleneck retainer. It should be appreciated that portions of the multi-purpose opening device of the invention advantageously can be made in the form of a unitary, injection molded plastic device of a suitable structural plastic or rubbery material, such as ABS. It should also be appreciated that portions or the entire device can be formed in aluminum, plastics, metal, or other alloy that supports a rigid sturdy construction in light of the intended uses for the present invention. The bottle retaining portion will preferably be made of a flexible material, which, like or if rubber, will allow the device to remain attached to the neck of a bottle for selective removal by a user/owner of the bottle.

The device of the invention, although having multiple advantageous uses, is simple and compact, and is easily and inexpensively manufactured. It is thus ideally suited for the end use intended. Because of its simplicity, compactness, and low cost, the device of the invention can be ubiquitously utilized as a kitchen appliance, camping and picnicking utensil, advertising and promotional item, personal safety device in public gathering places, novelty item, etc.

It should be understood, of course, that the specific form of the invention herein illustrated and described is intended to be representative only as certain changes may be made therein without departing from the clear teachings of the disclosure.

Accordingly, reference should be made to the following appended claims in determining the full scope of the invention.

I claim:

1. A beverage container opening and covering device, comprising:

a decorative housing provided in the form of miniaturized three-dimensional sports headgear including at least one of a football helmet, a baseball cap, and a cowboy hat, and further comprising a bottom, top, front, back, and sides, said decorative housing including an opening formed in its bottom and including a retention mechanism formed on an inner surface within said decorative housing, said retention mechanism adapted for retaining a twist-off bottle cap remover and bottle opening cover therein;

a twist-off bottle cap remover retained by the retention mechanism within the opening formed in the bottom of the decorative housing and adapted to accept and firmly grip twist off bottle caps during their removal from a beverage container;

a rubber retaining device integrated within said decorative housing with said twist-off bottle cap remover, said rubber retaining device adapted to enable said decorative housing to operate as a bottle opening cover, said bottle opening cover provided in the form of a rubber retaining device adapted for selectively securing the decorative cover to a bottle neck; and a can tab opener formed on the bottom of said decorative housing.

2. A beverage container opening and covering device, comprising:

a decorative housing provided in the form of miniaturized three-dimensional sports headgear including at least one of a football helmet, a baseball cap, and a cowboy hat, and further comprising a bottom, top, front, back, and sides, said decorative housing including an opening formed in its bottom and including a retention mechanism formed on an inner surface within said decorative housing, said retention mechanism adapted for retaining a combined twist-off bottle cap remover and bottle opening cover therein;

a twist-off bottle cap remover retained by the retention mechanism within the opening formed in the bottom of the decorative housing and adapted to accept and firmly grip twist off bottle caps during their removal from a beverage container;

a rubber retaining device integrated within said decorative housing with said twist-off bottle cap remover, said rubber retaining device adapted to enable said decorative housing to operate as a bottle opening cover, said bottle opening cover provided in the form of a rubber retaining device adapted for selectively securing the decorative cover to a bottle neck; and a pop-off bottle cap remover formed on the back of said decorative housing.

3. The beverage container opening and covering device of claim 1, further comprising:

a pop-off bottle cap remover formed on a back of said decorative housing.

4. The beverage container opening and covering device of claim 2, further comprising:

a can opener formed on the bottom of said decorative housing.

5. A beverage container opening and covering device, comprising:

a decorative housing provided in the form of miniaturized three-dimensional sports headgear including at least one of a football helmet, a baseball cap, and a cowboy hat, and having a bottom, top, front, back, and sides, said decorative housing including an opening formed in its bottom and including a retention mechanism formed on an inner surface within said decorative housing, said retention mechanism adapted for retaining a combined twist-off bottle cap remover and rubber retaining device therein;

a combined twist-off bottle-cap remover and rubber retaining device adapted to remove twist-off bottle caps from beverage containers and also secure said decorative housing onto an opened beverage container after the twist-off bottle cap is removed;

a pop-off bottle cap remover formed on a back of said decorative housing; and a can opener formed on the bottom of said decorative housing.

6. An beverage container opening and covering device of claim 5, said can opener further comprising an integral, outwardly extending tab formed along the bottom of said decorative housing.

7. A beverage container opener and cover, comprising:

(a) a decorative housing provided in the form of miniaturized three-dimensional sports headgear including at least one of a football helmet, a baseball cap, and a cowboy hat, and having a bottom, top, front, back, and sides, said decorative housing including (I) an opening formed in its bottom and including a retention mechanism formed on an inner surface of said decorative housing adapted for retaining a combined twist-off bottle cap remover and bottle opening cover and (II) and opening formed in its back adapted for receiving and removing pop-off bottle caps;

(b) a combined twist-off bottle-cap remover and bottle opening cover, said twist-off bottle cap remover formed in the shape of an inverted cup and adapted for receiving twist-off caps of various circumferences and said bottle opening cover provided in the form of a rubber retaining device adapted for selectively securing the decorative cover to a bottle neck; and (c) a can tab opener formed on the bottom of said decorative housing.

* * * * *